United States Patent [19]

Hori et al.

[11] 4,449,326

[45] May 22, 1984

[54] GLASS PANE HOLDER FOR WINDOW REGULATOR

[76] Inventors: Syunichi Hori, 8-24-301, Shimomeguro 6-chome, Meguro-ku, Tokyo; Isao Kurihashi, 67-3, Nakaechi, Atsugi-shi, Kanagawa, both of Japan

[21] Appl. No.: 374,647

[22] Filed: May 4, 1982

[30] Foreign Application Priority Data

Jun. 6, 1981 [JP] Japan ..... 56-87345
Jun. 6, 1981 [JP] Japan ..... 56-87346

[51] Int. Cl.[3] ..... E05F 11/38
[52] U.S. Cl. ..... 49/375; 49/352
[58] Field of Search ..... 49/352, 350, 351, 374, 49/375

[56] References Cited

U.S. PATENT DOCUMENTS 4,237,657 12/1980 Kazewych ..... 49/375 X
4,241,542 12/1980 Podolan et al. ..... 49/375 X
4,299,057 11/1981 Hagemann et al. ..... 49/375

FOREIGN PATENT DOCUMENTS 2843633 4/1980 Fed. Rep. of Germany ..... 49/375

*Primary Examiner*—Kenneth Downey

[57] ABSTRACT

A glass pane holder is disclosed for use with a window regulator of an automobile including a flexible elongated drive member slidable extending through a guide track having a lengthwise extending slotted opening. The holder comprises a bracket molded from a hard resin so as to have a pair of opposite walls which define an elongate slot therebetween which receives the lower edge of a glass pane, and a connection member detachably mounted on the bracket and engageable with the drive member through the slotted opening formed in the guide track. The connection member is formed by a single foldable metal strip, and comprises a pair of wings which are mounted on the bracket, a grip located intermediate the wings and shaped, by a press operation, into substantially Ω-configuration in section which defines a closed groove adapted to receive the drive member, and a neck formed between the pair of wings and the grip. The grip includes a groove or projection engageable with the drive member which is received in the closed groove.

6 Claims, 11 Drawing Figures

GLASS PANE HOLDER FOR WINDOW REGULATOR

FIELD OF THE INVENTION

The invention relates to a regulator arrangement for opening or closing a side window of an automobile, and more particularly, to a glass pane holder for operatively coupling a glass pane to a regulator arrangement having a flexible elongated drive member.

DESCRIPTION OF THE PRIOR ART

One form of usual glass pane holder which is applicable to a variety of window regulators is disclosed in U.S. Pat. No. 4,026,088 assigned to the common assignee as the present application. The disclosed glass pane holder comprises a bracket having a pair of opposite sidewalls which define an elongated slot which receives the bottom of a glass pane, and a connection member which depends downwardly from the bracket in an integral manner therewith. The bottom end of the glass pane which is received in the elongated slot is securely fastened to the bracket by means of an adhesive, and the connection member is operatively mounted on a drive member of a window regulator. In the glass pane holder disclosed, both the bracket and the connection member are integrally molded from a hard resin, with a metal nut firmly embedded into the connection member. The drive member of the window regulator is directly screwed into the metal nut mounted on the connection member or operatively engaged with a guide bushing which is in turn screwed into the nut. The disclosed glass pane holder is satisfactorily fits in a window regulator of a link or lever type as disclosed in U.S. Pat. Nos. 4,151,683 and 3,890,742, for example. However, for its use with a window regulator of the type having a flexible elongated drive member such as a perforated plastic tape or a helical pushpull cable formed by a metal wire which slides within a guide track or a sleeve, a specially constructed engaging member must be provided. An example of window regulator which utilizes a flexible elongated drive member is disclosed in U.S. Pat. No. 4,004,371, for example.

SUMMARY OF THE INVENTION

It is an object of the invention to provide a glass pane holder which firmly mounts the bottom end of a glass pane and capable of coupling the glass pane with a flexible elongated drive member of a window regulator in a simple manner.

In accordance with the invention, there is provided a glass pane holder for coupling a glass pane to a window regulator including a flexible elongated drive member which slidably passes through a guide track member having a lengthwise exchanging slotted opening. The holder comprises a bracket molded from a hard resin so as to exhibit a pair of opposite walls which define an elongated slot therebetween in which an edge of the glass pane is received, and a connection member detachably mounted on the bracket and including a grip which is engageable with the flexible elongated drive member through the slotted opening formed in the guide track member.

It is a feature of the glass pane holder of the invention that the connection member is formed by a single foldable metal strip and comprises a pair of wings which lie in a common plane, a grip located intermediate the wings and which is folded into substantially Ω-configuration in cross section which defines a closed groove adapted to receive the flexible elongated drive member of the window regulator, and a neck formed between the pair of wings and the grip, the grip including means which is engageable with the flexible elongated drive member which extends through the closed groove. Where the flexible drive member is formed as a perforated plastic tape, the engaging means may be an inwardly extending projection formed by a U-shaped notch. Where the drive member comprises a helical pushpull cable formed by metal wire, the engaging member may be in the form of a helical groove having the same pitch. The connection member is mounted on the drive member before the latter is inserted into the guide track. When the connection member is folded in a manner such that the pair of wings form an angle with respect to each other, the closed groove in the grip is opened, whereupon the flexible elongated drive member may be received in the open groove. The connection member is then returned to its original position, thereby completing the mounting thereof. Subsequently, the drive member is inserted into one end of the guide track together with the grip. This takes place readily by engaging the neck of the connection member with a slotted opening of the guide track and manually pulling the wings disposed, outside the guide track, through the neck.

In a preferred embodiment of the invention, the connection member is detachably mounted on the bracked by a sliding engagement. The sliding engagement can be achieved in a variety of manners. Generally, the bracket includes at least two grooves or ribs which are engageable with the pair of wings of the connection member.

DESCRIPTION OF EMBODIMENTS

Figure 1:
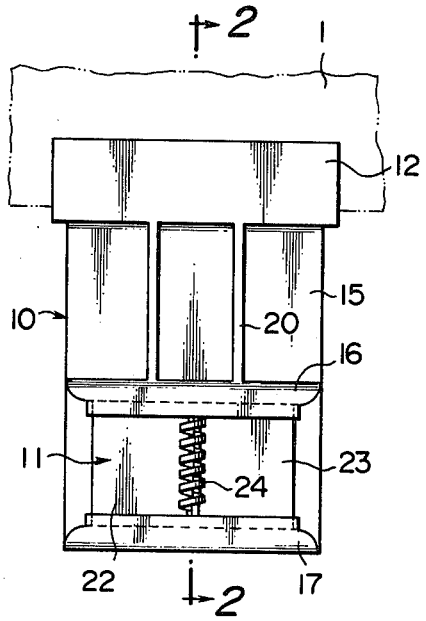
FIG. 1 is a front view of a glass pane holder according to the invention which includes a bracket and a connection member.

Four embodiments of the invention are illustrated in the attached drawings and will be sequentially described. However, it is to be noted that throughout the drawings, substantially similar parts are designated by like reference characters.

Figure 2:
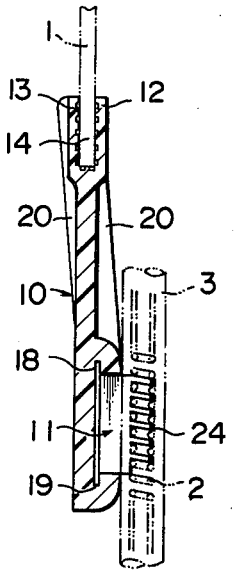
FIG. 2 is a cross section taken along the line 2—2 shown in FIG. 1.
Figure 3:
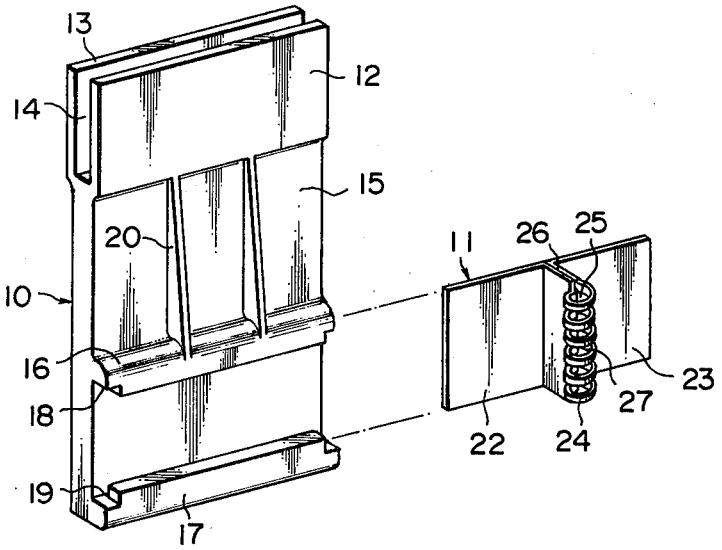
FIG. 3 is a perspective view of the glass pane holder shown in FIG. 1 when the connection member is dismounted from the bracket.

Referring to FIGS. 1 to 3 which illustrate a first embodiment, a glass pane holder according to the invention comprises a bracket 10 which is mounted on the bottom edge of a glass pane 1, and a connection member mounted on the bracket 10 and engageable with a flexible elongated drive member 2 of a window regulator, not shown. The bracket 10 is molded from a hard resin, and includes a pair of opposite walls 12, 13 on its top which define a transversely elongate slot 14 therebetween. An adhesive is applied to the inner of the walls 12, 13 for firmly securing the lower edge of the glass pane 1 which is inserted into the slot 14. The manner of holding the glass pane 1 in the slot 14 in this manner is described in detail in cited U.S. Pat. No. 4,026,088. The bracket 10 includes a plate-shaped body 15 having a pair of transversely extending, parallel ribs 16, 17 formed on its one surface. A pair of grooves 18, 19 are formed in the sides of the ribs 16, 17 which oppose each other. A plurality of reinforcing ribs 20 are formed on the opposite surfaces of the body 15 and extend in a direction perpendicular to the ribs 16, 17.

The connection member 11 is formed by a foldable metal strip, and comprises a pair of wings 22, 23 which lie in a common plane, a grip 24 located intermediate the wings 22, 23 and which is formed into substantially Ω-configuration in section, as by a press operation, which defines a closed groove 25 which is adapted to receive a flexible elongated drive member 2 of the window regulator, and a neck 26 formed between the wings 22, 23 and the grip 24. The connection member 11 is mounted on the bracket 10 by engaging the wings 22, 23 with the transversely extending grooves 18, 19 formed in the bracket 10, in a slidable manner. The drive member 2 comprises a pushpull cable formed by a helical winding of a metal wire and which is slidably disposed in a guide track or sleeve 3 having a lengthwise extending slotted opening (not shown). While not shown, the guide track or sleeve 3 is secured to the interior of a door of an automobile while the drive member 2 is operatively coupled to an actuator which is mounted on the door. The construction of such a window regulator arrangement is known in itself. Alternatively, a perforated plastic tape as disclosed in U.S. Pat. No. 4,004,371 may be utilized. The neck 26 is engaged with the slotted opening of the guide track 3, with the grip 24 grasping the pushpull cable 2 within the track 3. To achieve a firm coupling between the connection member 11 and the cable 2, the grip 24 has substantially the same diameter as the cable which extends through the closed groove 25 formed therein and is internally formed with a helical groove 27 for engagement with the cable 2. In this manner, a complementary meshing engagement is achieved between the grip 24 and the cable 2. It is to be understood that the connection member 11 is coupled with the cable 2 before the latter is inserted into the guide track 3. When mounting, the connection member 11 may be folded in a manner such that the wings 22, 23 form an angle with respect to each other to thereby open the groove 25 formed in the grip 24 so as to receive the cable 2 therein. When the connection member 11 is released, the cable 2 is received in the groove 25. Subsequently, the pushpull cable 2 is inserted into one end of the guide track 3, and the wings 22, 23, which are located outside the track 3, are manually pulled until the neck 26 is engaged with the slotted opening in the track 3. Finally, the wings 22, 23 are slidably engaged with the grooves 18, 19 formed in the bracket 10.

Figure 4:
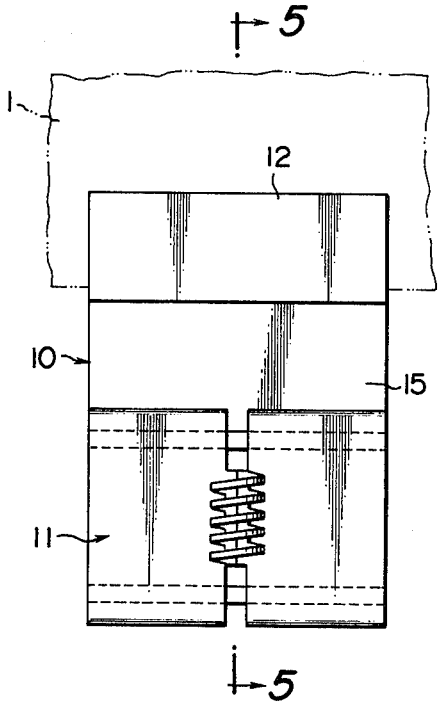
FIGS. 4, 5 and 6 show another embodiment of the invention in a manner corresponding to FIGS. 1, 2 and 3, respectively.
Figure 5:
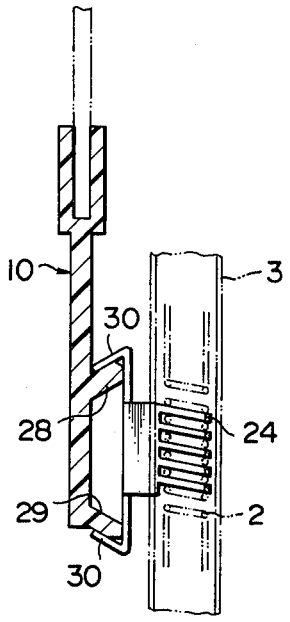
Figure 6:
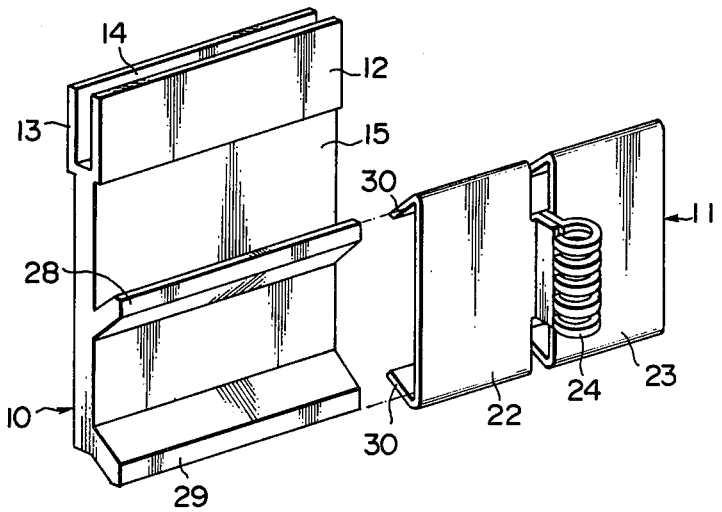

Referring to FIGS. 4 to 6, there is shown a second embodiment of the invention which is slightly modified from the first embodiment in the manner of sliding engagement between the bracket 10 and the connection member 11. In this embodiment, a pair of transversely extending, diverging ribs 28, 29 are formed on one surface of the body 15 of the bracket 10. The connection member 11 is additionally provided with pawls 30, which are formed by edge portions of the wings 22, 23 which are folded back along their top and bottom ends. These pawls 30 slidably engage the diverging ribs 28, 29, thus mounting the connection member 11 on the bracket 10.

Figure 7:
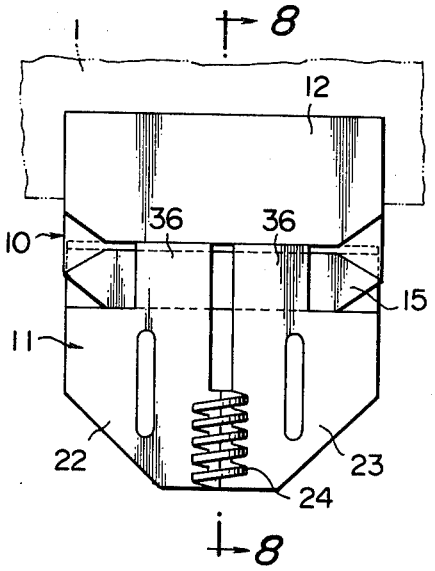
FIGS. 7, 8 and 9 show a further embodiment of the invention in a manner corresponding to FIGS. 1, 2 and 3, respectively.
Figure 8:
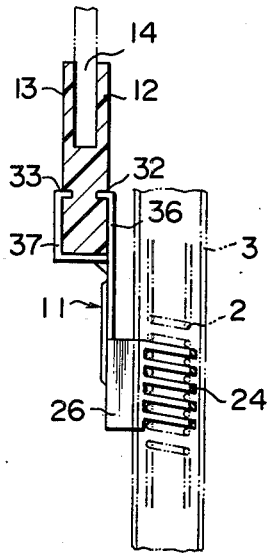
Figure 9:
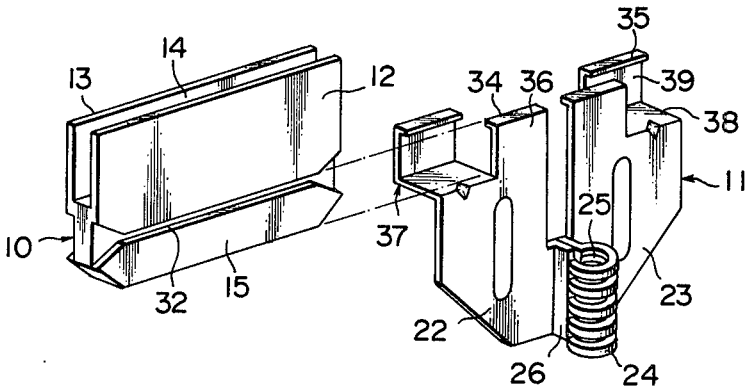

Referring to FIGS. 7 to 9, there is shown a third embodiment of the invention. A pair of transversely extending grooves 32, 33 are formed in the opposite surfaces of the body 15 of the bracket 10, and are engaged by pairs of pawls 34, 35, formed on the wings 22, 23 and which face each other. One of the pawls, 34, is formed at the upper end of an upright extension 36 which lies in the common plane as the associated wing while the other pawl 35 is formed at the upper end of an L-shaped extension 37. The L-shaped extension 37 includes a horizontal portion 38, the length of which substantially corresponds to the thickness of the body 15 of the bracket 10. The L-shaped extension 37 also includes an upright portion 39, the height of which is substantially equal to that of the upright extension 36.

Figure 10:
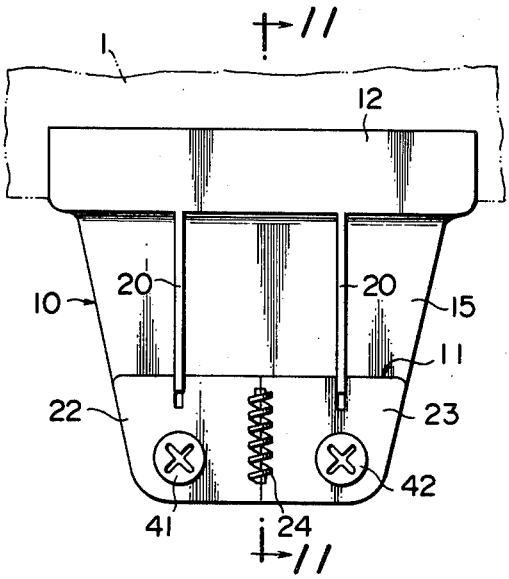
FIGS. 10 and 11 are similar views to FIGS. 1 and 2, respectively, illustrating still another embodiment of the invention.
Figure 11:
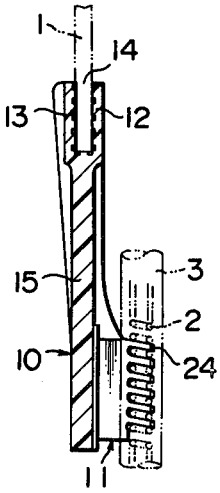

Referring to FIGS. 10 and 11, there is shown a fourth embodiment of the invention in which the sliding engagement between the bracket 10 and the connection member 11, as disclosed in the preceding three embodiments, is replaced by a threadable engagement. In this embodiment, the connection member 11 is mounted on the bracket 10 by securing the pair of wings 22, 23 to the bracket 10 by means of screws 41, 42.

What is claimed is:

1. A glass pane holder for coupling a glass pane to a window regulator including a flexible elongated drive member which slidably extends through a guide track having a lengthwise extending slotted opening; comprising a bracket molded from a hard resin and having a pair of opposite walls which define a transversely extending elongate slot therebetween which receives an edge portion of the glass pane;

and a connection member detachably mounted on the bracket and engageable with the flexible elongated drive member through the slotted opening formed in the guide track;

the connection member being formed by a single foldable material and including a pair of wings which lie in a common plane, a grip located intermediate the wings and formed, by a press operation, into substantially Ω-configuration in section which define a closed groove in which the flexible elongated drive member of the window regulator is received, and a neck formed between the pair of wings and the grip, the grip including means engageable with the drive member which extends through the closed groove.

2. A glass pane holder according to claim 1 in which the drive member comprises a pushpull cable formed by a helical winding of a metal wire, said means of the grip being formed by a helical groove which permits a complementary meshing engagement with the pushpull cable.

3. A glass pane holder according to claim 1 in which the bracket has a pair of spaced, transversely extending ribs on one of its surfaces, a pair of grooves being formed in the ribs so as to be located opposite to each other, the pair of wings of the connection member being slidably received in the grooves, thereby mounting the connection member on the bracket.

4. A glass pane holder according to claim 1 in which the bracket has a pair of spaced, transversely extending and diverging ribs on one of its surfaces, the connection member having a plurality of pawls formed integrally with and extending from the upper and the lower end of the pair of wings, the pawls being slidably engaged with the diverging ribs to thereby mount the connection member on the bracket.

5. A glass pane holder according to claim 1 in which the bracket is formed with a pair of transversely extending grooves which are formed in its opposite surfaces, each of the wings of the connection member being integrally formed with a pair of opposing pawls on its top, one of the pawls being formed at the end of an upright extension which lies in a common plane as the associated wing, the other pawl being formed at the end of an L-shaped extension, the pairs of pawls slidably engaging the respective grooves, thereby mounting the connection member on the bracket.

6. A glass pane holder according to claim 1 in which the connection member is mounted on the bracket by securing the respective wings to the latter by means of screws.

* * * * *

UNITED STATES PATENT AND TRADEMARK OFFICE

CERTIFICATE OF CORRECTION

PATENT NO. : 4,449,326

DATED : May 22, 1984

INVENTOR(S) : Syunichi Hori and Isao Kurihashi

It is certified that error appears in the above-identified patent and that said Letters Patent is hereby corrected as shown below:

On the title page add:

[73] Assignee: Hori Glass Co., Ltd.
Kanagawa, Japan

Signed and Sealed this

*Eleventh* Day of *December 1984*

[SEAL]

*Attest:*

GERALD J. MOSSINGHOFF

*Attesting Officer*

*Commissioner of Patents and Trademarks*